US011180895B2

(12) United States Patent
Sennhauser

(10) Patent No.: US 11,180,895 B2
(45) Date of Patent: Nov. 23, 2021

(54) SAFETY NET

(71) Applicant: Geobrugg AG, Romanshorn (CH)

(72) Inventor: Marcel Sennhauser, Wittenbach (CH)

(73) Assignee: Geobrugg AG, Romanshorn (CH)

( * ) Notice: Subject to any disclaimer, the term of this patent is extended or adjusted under 35 U.S.C. 154(b) by 0 days.

(21) Appl. No.: 16/754,917

(22) PCT Filed: Sep. 28, 2018

(86) PCT No.: PCT/EP2018/076388
§ 371 (c)(1),
(2) Date: Apr. 9, 2020

(87) PCT Pub. No.: WO2019/072586
PCT Pub. Date: Apr. 18, 2019

(65) Prior Publication Data

US 2020/0308785 A1 Oct. 1, 2020

(30) Foreign Application Priority Data

Oct. 12, 2017 (DE) ..... 10 2017 123 816.6

(51) Int. Cl.
*E01F 7/04* (2006.01)
*B21F 27/00* (2006.01)

(52) U.S. Cl.
CPC ..... *E01F 7/045* (2013.01); *B21F 27/00* (2013.01)

(58) Field of Classification Search
CPC ..... B21F 27/00; B21F 27/005; B21F 27/02; B21F 29/00; E01F 7/04; E01F 7/045; E04H 17/02; E04H 17/04; E04H 17/05
(Continued)

(56) References Cited

U.S. PATENT DOCUMENTS 1,859,831 A * 5/1932 Land ..... B21F 27/005 245/7
1,943,447 A * 1/1934 Land ..... B21F 27/005 245/6

(Continued)

FOREIGN PATENT DOCUMENTS

CH 339242 A * 6/1959 ..... E01F 7/04
CH 677376 A5 5/1991

(Continued)

OTHER PUBLICATIONS

Office Action dated Oct. 9, 2020 issued in corresponding RU patent application No. 2020114887 (and English machine translation).

(Continued)

*Primary Examiner* — Josh Skroupa
(74) *Attorney, Agent, or Firm* — Posz Law Group, PLC

(57) ABSTRACT

A safety net, in particular for catching heavy loads, preferably dynamic impact bodies, in particular rocks, is formed at least to a large extent by mutually engaging net elements, and a maximum overall extension of the safety net parallel to a main extension direction of the safety net is substantially greater in an exterior region of the safety net, which in particular includes at least one outermost row of net elements, than a minimum overall extension of the safety net parallel to the main extension direction in an interior region of the safety net which differs from the exterior region.

20 Claims, 10 Drawing Sheets

(58) Field of Classification Search
USPC ..... 245/2, 4, 5, 7, 8; 256/12.5, 32, 33, 45
See application file for complete search history.

(56) References Cited

U.S. PATENT DOCUMENTS

| | | | | |
|---|---|---|---|---|
| 6,279,858 | B1 | 8/2001 | Eicher | |
| 8,646,491 | B2 * | 2/2014 | Ferraiolo | B65G 1/02 140/6 |
| 8,807,535 | B2 | 8/2014 | Stelzer et al. | |
| 2007/0131917 | A1 * | 6/2007 | Wartmann | B21F 27/02 256/12.5 |
| 2009/0022549 | A1 | 1/2009 | Wartmann | |

FOREIGN PATENT DOCUMENTS

| | | | | | |
|---|---|---|---|---|---|
| CN | 105568876 | A | | 5/2016 | |
| DE | 297 21 851 | U1 | | 4/1998 | |
| DE | 203 00 821 | U1 | | 5/2003 | |
| EP | 0 370 945 | A1 | | 5/1990 | |
| EP | 1 538 265 | A1 | | 6/2005 | |
| EP | 2 017 389 | A2 | | 1/2009 | |
| EP | 3 056 608 | A1 | | 8/2016 | |
| FR | 1190613 | A | * | 10/1959 | E01F 7/04 |
| FR | 1218899 | A | * | 5/1960 | E01F 7/04 |
| JP | H10-280332 | A | | 10/1998 | |
| JP | 2002322616 | A | | 11/2002 | |
| JP | 2005113424 | A | | 4/2005 | |
| JP | 2006173221 | A | | 6/2006 | |
| JP | 2007146626 | A | | 6/2007 | |
| JP | 1064668 | B2 | | 3/2008 | |
| JP | 2009102855 | A | | 5/2009 | |
| JP | 2010088527 | A | | 4/2010 | |
| JP | 2013217020 | A | | 10/2013 | |
| JP | 2014001584 | A | | 1/2014 | |
| KR | 101551174 | B1 | | 9/2015 | |
| KR | 10-1820910 | B1 | | 10/2016 | |
| WO | 99/43894 | A1 | | 9/1999 | |
| WO | 03091502 | A1 | | 11/2003 | |
| WO | 2015/128177 | A1 | | 9/2015 | |

OTHER PUBLICATIONS

First Examination Report dated Jan. 22, 2021 issued in corresponding AU patent application No. 2018350279.
First Examination Report dated Feb. 4, 2021 issued in corresponding IN patent application No. 202017013166.
Second Examination Report dated Apr. 15, 2021 issued in corresponding AU application No. 2018350279.
Search Report dated Sep. 6, 2018 issued in corresponding DE Patent Application No. 10 2017 123 816.6 (partial English translation only).
International Search Report dated Jan. 15, 2019 issued in corresponding International Patent Application No. PCT/EP2018/076388 (English translation only).
International Preliminary Report on Patentability dated Apr. 14, 2020 issued in corresponding International Patent Application No. PCT/EP2018/076388 (English translation only).
Examination Report dated Apr. 21, 2021, issued in corresponding CA Patent Application No. 3,075,473.
Examination Report dated Apr. 15, 2021, issued in corresponding CL Patent Application No. 824-2020 (and English Machine Translation).
Examination Report dated Apr. 21, 2021, issued in corresponding CN Patent Application No. 201880066055.9 (and English Machine Translation).
Examination Report dated May 11, 2021, issued in corresponding JP Patent Application No. 2020-518044 (and English Machine Translation).
Examination Report dated May 25, 2021, issued in corresponding KR Patent Application No. 10 2020 7013247 (and English Machine Translation).
European Office Action dated Jul. 8, 2021 issued in corresponding EP Application No. 18 783 392.6 (and English translation).

* cited by examiner

SAFETY NET

CROSS REFERENCE TO RELATED APPLICATIONS

This application is a U.S. national stage application of PCT/EP2018/076388 filed on Sep. 28, 2018, which is based on German Patent Application No. 10 2017 123 816.6 filed on Oct. 12, 2017, the contents of which are incorporated herein by reference.

PRIOR ART

The invention relates to a safety net according to the preamble of claim 1.

A safety net for catching rocks has already been proposed, the safety net being formed at least to a large extent by mutually engaging net elements.

The object of the invention consists, in particular, in providing a generic safety net which has increased safety. The object is achieved according to the invention by the features of claim 1, whilst advantageous designs and further developments of the invention can be found in the subclaims.

Advantages of the Invention

The invention proceeds from a safety net, in particular for catching heavy loads, preferably dynamic impact bodies, in particular rocks, wherein the safety net is formed at least to a large extent by mutually engaging net elements.

It is proposed that a maximum overall extension of the safety net parallel to the main extension direction of the safety net, is greater, in particular substantially, in an exterior region of the safety net, which includes, in particular, at least one outermost row of net elements, than a minimum overall extension of the safety net parallel to the main extension direction in an interior region of the safety net which differs from the exterior region. As a result, increased safety can advantageously be made possible, in particular with regard to catching dynamic impact bodies in the safety net. In an advantageous manner, a catch area, in which dynamic impact bodies are able to be reliably trapped, can be enlarged, in particular by the catch area being able to be kept advantageously large after an impact of the dynamic impact bodies. In an advantageous manner, it is possible to avoid a forming of open positions and/or holes on account of an impact of a dynamic impact body, in particular in a region which has been covered by the catch area prior to the impact, as a result of which it is advantageously possible to prevent a further dynamic impact body falling through the safety net in the case of a further impact which follows the impact. It is advantageously possible to create an additional buffer path by means of additional net elements, which give way in particular when loaded, on at least one outer edge at which the safety net is suspended, as a result of which it is advantageously possible to cushion an impact in a better manner. In addition, it is advantageously possible to absorb an impact of a dynamic impact body in the vicinity of an edge of the safety net, in particular by an additional buffer path, in particular thereby reducing possible damage to a suspension of the safety net. Furthermore, simple guiding of the net elements about a support element which bears the safety net can be made possible by means of the safety net according to the invention in the mounted state. In addition, stability is also able to be advantageously improved, in particular by a force which cooperates with the safety net being able to be distributed advantageously to a large number of net elements, in addition, in particular an advantageous, in particular uniform, force distribution being able to be achieved, as a result of which it is possible to optimize, in particular, at least one trapping characteristic, such as, for example, deformability, extensibility, a spring-back characteristic, breakthrough strength, etc., of the safety net for catching at least one dynamic impact body. In addition, the safety net according to the invention enables, in particular, a simplified assembly, as a result of which it is advantageously possible to reduce costs and expenditure on material and/or assembly.

A "dynamic impact body" is to be understood, in particular, as a mass moved under the influence of a gravitational potential. In particular, the dynamic impact body includes at least one rock, preferably rubble and/or frozen water. As an alternative to this or in addition to it, the dynamic impact body can also include machines or machine parts, for example of means of transportation and/or construction machinery, and/or living organisms or parts of living organisms, for example tree trunks and/or branches. In particular, a "heavy load" is heavier than 1 kg, preferably heavier than 10 kg, in a preferred manner heavier than 100 kg and in a particularly preferred manner heavier than 1000 kg. A "net element" is to be understood, in particular, as an, in particular separable, base element of the safety net which realizes the safety net by means of a mutual engaging with neighboring base elements. The net element is preferably realized as a filament-like structure, in particular wire structure, which is closed per se. As an alternative to this, the net element can be realized as at least one helix of a mesh network. The structure, in particular wire structure, is preferably substantially in one plane in a non-loaded state. The filament-like structure, in particular the wire structure, preferably the wire of the wire structure, is preferably a high-strength steel wire. For example, the high-strength steel can be spring steel and/or wire steel and/or a steel suitable for wire ropes. In particular, the wire comprises a tensile strength of at least 800 N $mm^{-2}$, advantageously of at least 1000 N $mm^{-2}$, particularly advantageously of at least 1200 N $mm^{-2}$, preferably of at least 1400 N $mm^{-2}$ and in a particularly preferred manner of at least 1600 N $mm^{-2}$, in particular a tensile strength of approximately 1770 N $mm^{-2}$ or a tensile strength of approximately 1960 N $mm^{-2}$. It is also conceivable for the wire to comprise an even higher tensile strength, for example a tensile strength of at least 2000 N $mm^{-2}$ or of at least 2200 N $mm^{-2}$ or even of at least 2400 N $mm^{-2}$. As a result, it is possible to achieve a high load capacity, in particular a high tensile strength and/or a high level of rigidity transversely to the mesh. In addition, advantageous bending characteristics can also be achieved. The net element can comprise, in particular, an irregular form or preferably a regular form which provides at least in part a form of a circle, a diamond and/or a regular and/or irregular polygon. In particular, various net elements of the safety net can comprise various forms, in a preferred manner, however, the net elements comprise a substantially identical form. In a preferred manner, the net element is realized as a ring, in particular a wire ring. In particular, the net element forms a net member of a ring network at least in part. A net member includes, in particular, at least one bundle of net elements or preferably precisely one individual net element. A bundle of net elements is to be understood, in particular, as a plurality of net elements which are provided for the purpose of lying one above another in a substantially concentric manner in a safety net. The net elements preferably comprise at least one diameter of 3 cm, in a preferred manner at least of 5 cm and in a particularly preferred manner of less than 40 cm. The term "to a large extent" is to be understood, in particular in this connection, as in particular up to at least 80%, preferably up to at least 90%, in a preferred manner up to at least 95% and in a particularly preferred manner completely. The term "overall extension" is to be understood, in particular, as an extension between two oppositely situated outermost edges of the safety net. A "main extension direction" of an object is to be understood, in this case, in particular, as a direction which runs parallel to a longest edge of a smallest geometrical cuboid which barely surrounds the object completely. In particular, any type of extension is to be understood such that it is measured with a safety net spread-out in a completely flat manner, in particular devoid of inner stresses. An "outermost row of net elements" is to be understood, in particular, as a row, which extends along a straight line, of net elements which are devoid of neighboring net elements on at least one common side. The exterior region extends, in particular, in a main extension direction of the safety net at least over an entire extent, in particular over an in particular maximum overall extension, of the safety net. The exterior region preferably includes at least a plurality, of in particular complete rows of net elements, which extend along a straight line which is preferably parallel to the main extension direction, in a preferred manner at least two, in particular complete, rows of net elements which extend along a straight line which is preferably parallel to the main extension direction and in a particularly preferred manner at least one, in particular complete, row of net elements which extends along a straight line which is preferably parallel to the main extension direction. The exterior region preferably includes at least one outermost row of net elements. The interior region extends in particular in a main extension direction of the safety net at least over an entire extent, in particular over a, in particular minimum overall extension, of the safety net. The interior region preferably includes at least a plurality, of in particular complete rows of net elements, which extend along a straight line which is preferably parallel to the main extension direction, in a preferred manner at least two, in particular complete, rows of net elements which extend along a straight line which is preferably parallel to the main extension direction and in a particularly preferred manner at least one, in particular complete, row of net elements which extends along a straight line which is preferably parallel to the main extension direction. In particular, the exterior region and the interior region are without overlap with respect to one another.

It is additionally proposed that the maximum overall extension of the safety net parallel to a main extension direction of the safety net is greater in the exterior region at least by one, preferably by at least two, in a preferred manner by at least three mean diameter(s) of the net elements and/or is greater by at least 5%, preferably by at least 10%, in a preferred manner by at least 15% and in a particular preferred manner by at least 20%, than the minimum overall extension of the safety net parallel to the main extension direction in the interior region which differs from the exterior region. In particular, increased safety can be made possible in an advantageous manner as a result of such a design of the safety net in particular with regard to catching dynamic impact bodies in the safety net. In an advantageous manner, a catch area in which dynamic impact bodies can be reliably trapped can be increased in size, in particular by the catch area being able to be kept advantageously large after an impact of the dynamic body. It is advantageously possible to create an additional buffer path by means of additional net elements, which give way in particular when loaded, on at least one outer edge at which net elements are suspended, as a result of which it is advantageously possible to cushion an impact in a better manner A "mean diameter" is to be understood, in particular, as an average diameter of net elements when seen in a substantially planar spreading direction of the safety net. In particular, a plurality of randomly determined, in a preferred manner all, net elements of the safety net is/are used to calculate the mean diameter. A diameter of an individual net element is calculated preferably from an average of a diameter parallel to the main extension direction of the safety net and/or of a diameter perpendicular to the main extension direction of the safety net. A "diameter" of a net element is to be understood preferably as a diameter of a smallest circle which includes the net element completely, in particular in a main extension direction of the safety net. In particular, a form of a spread-out safety net deviates from a rectangular form by at least one corner.

It is additionally proposed that a maximum overall extension of the safety net parallel to a main extension direction of the safety net is greater in a further exterior region of the safety net, which differs from the exterior region and includes, in particular, at least one further outermost row of net elements which differs, in particular, from the outermost row of net elements, than a minimum overall extension of the safety net parallel to the main extension direction in an interior region of the safety net which differs from the exterior region and from the further exterior region. In particular, as a result of such a design of the safety net, increased safety can advantageously be made possible, in particular with regard to catching dynamic impact bodies in the safety net. In an advantageous manner, a catch area, in which dynamic impact bodies are able to be reliably trapped, can be enlarged. It is advantageously possible to create an additional buffer path by means of additional net elements, which give way in particular when loaded, on at least one outer edge at which net elements are suspended, as a result of which it is advantageously possible to cushion an impact in a better manner, in particular by being able to keep the catch area advantageously large after an impact of the dynamic impact body. The further exterior region extends, in particular, in a main extension direction of the safety net at least over an entire extent, in particular over an, in particular, maximum overall extension of the safety net. The further exterior region preferably includes at least a plurality, in particular of complete rows of net elements which extend along a straight line which is preferably parallel to the main extension direction, in a preferred manner at least two, in particular complete rows of net elements which extend along a straight line which is preferably parallel to the main extension direction and in a particularly preferred manner at least one, in particular complete row of net elements which extends along a straight line which is preferably parallel to the main extension direction. The further exterior region preferably includes at least one outermost row of net elements. The exterior region the further exterior region and/or the interior region are preferably without overlap with respect to one another. The further exterior region preferably includes a further outer edge of the safety net which is located opposite an outer edge included in the exterior region in a direction perpendicular to the main extension direction of the safety net. In particular, the form of the spread-out safety net deviates from a rectangular form in particular at least at two corners. The main extension direction of the exterior region, of the further exterior region and/or of the interior region preferably extend/s in a plane parallel to the safety net perpendicularly and/or in a preferred manner parallel to the main extension direction of the safety net. The exterior region, the further exterior region and/or the inner region preferably includes/include at least one, in a preferred manner at least two, side edge/side edges of the safety net which extend, in particular, at least partially angled and/or at least partially perpendicular to the main extension direction.

It is also proposed that the net elements are arranged in a mirror symmetrical manner with reference to a mirror plane which is at least substantially perpendicular to a main extension plane of the safety net and/or with reference to a mirror plane which is at least substantially parallel to a main extension direction of the safety net. In particular, as a result of such a design of the safety net, increased safety can advantageously be made possible, in particular with regard to catching dynamic impact bodies in the safety net. In an advantageous manner, a catch area, in which dynamic impact bodies are able to be reliably trapped, can be enlarged, in particular by the catch area being able to be kept advantageously large after an impact of the dynamic body. It is advantageously possible to create an additional buffer path by means of additional net elements, which give way in particular when loaded, on at least one outer edge at which net elements are suspended, as a result of which it is advantageously possible to cushion an impact in a better manner. In particular, the form of the spread-out safety net deviates from a rectangular form by at least four corners. A "main extension direction" of a structural unit is to be understood, in particular, as a plane which is parallel to a largest side surface of a smallest imaginary cuboid which barely surrounds the structural unit completely and which runs, in particular, through the center point of the cuboid.

It is additionally proposed that at least one partial region of the safety net, in particular an exterior region of the safety net, which protrudes over the interior region, in particular over an overall extension of the interior region, in a direction parallel to a main extension direction of the safety net comprises at least four, preferably at least six, in a preferred manner at least nine and in a particularly preferred manner at least twelve net elements. In particular, as a result of such a design of the safety net, increased safety can advantageously be made possible, in particular with regard to catching dynamic impact bodies in the safety net. In an advantageous manner, a catch area, in which dynamic impact bodies are able to be reliably trapped, can be enlarged, in particular by the catch area being able to be kept advantageously large after an impact of the dynamic body. The term "at least one partial region of the safety net which protrudes over the interior region in a direction parallel to a main extension direction of the safety net" is to be understood, in particular, as an exterior region. An "exterior region" of the safety net is to be understood, in particular, as at least one partial region of the safety net which forms an overlap over a rectangular region, of a maximum size, of the safety net which is completely covered by the safety net. The exterior region preferably includes at least one net element, in a preferred manner a plurality of net elements, which protrude beyond the minimum extension of the safety net in a main extension direction.

It is additionally proposed that at least one partial region of the safety net, in particular an exterior region of the safety net, which protrudes over the interior region, in particular over an overall extension of the interior region, in a direction parallel to a main extension direction of the safety net, comprises a number of net elements, which are arranged side by side in a row in the main extension direction of the safety net, which corresponds to at least a twentieth, preferably at least a fifteenth, in a preferred manner at least a tenth and in a particularly preferred manner at least a fifth of a maximum number of all rows of net elements arranged side by side perpendicularly to the main extension direction of the safety net. In particular, as a result of such a design of the safety net, increased safety can advantageously be made possible, in particular with regard to catching dynamic impact bodies in the safety net. In an advantageous manner, a catch area, in which dynamic impact bodies are able to be reliably trapped, can be enlarged, in particular by the catch area being able to be kept advantageously large after an impact of the dynamic impact body.

It is additionally proposed that at least one partial region of the safety net, in particular an exterior region of the safety net, which protrudes over the interior region, in particular over an overall extension of the interior region, in a direction parallel to a main extension direction of the safety net, comprises a number of net elements, which are arranged side by side in a row perpendicularly to the main extension direction of the safety net, which corresponds to at least a tenth, preferably at least an eighth, advantageously at least a sixth, in a preferred manner at least a quarter and in a particularly preferred manner at least half of a maximum number of all rows of net elements arranged side by side perpendicularly to the main extension direction of the safety net. In particular, as a result of such a design of the safety net, increased safety can advantageously be made possible, in particular with regard to catching dynamic impact bodies in the safety net. In an advantageous manner, a catch area, in which dynamic impact bodies are able to be reliably trapped, can be enlarged, in particular by the catch area being able to be kept advantageously large after an impact of the dynamic impact body. The number of net elements arranged side by side in a row perpendicularly to the main extension direction of the safety net in the partial region of the safety net protruding over the interior region, in particular over an overall extension of the interior region, in a direction parallel to a main extension direction of the safety net, preferably corresponds to at least half the number, preferably to at least the precise number and in a preferred manner to at least twice the number of net elements arranged side by side in a row parallel to the main extension direction of the safety net in the partial region.

It is also proposed that at least one partial region of the safety net, in particular an exterior region of the safety net, which protrudes over the interior region, in particular over an overall extension of the interior region, in a direction parallel to a main extension direction of the safety net, comprises an at least substantially triangle-shaped arrangement of net elements. In particular, as a result of such a design of the safety net, increased safety can advantageously be made possible, in particular with regard to catching dynamic impact bodies in the safety net. In an advantageous manner, a catch area, in which dynamic impact bodies are able to be reliably trapped, can be enlarged, in particular by the catch area being able to be kept advantageously large after an impact of the dynamic impact body. The triangle-shaped arrangement preferably comprises substantially a form of a triangle which tapers at an angle of less than 45° in the main extension direction of the safety net. As an alternative to this, the triangular form can also be in the form of a substantial isosceles triangle and/or in the form of a triangle which converges at an angle greater than 45° in the main extension direction of the safety net.

It is further proposed that at least one net element of at least one partial region of the safety net, in particular of an exterior region of the safety net, which protrudes over the interior region, in particular over an overall extension of the interior region, in a direction parallel to a main extension direction of the safety net comprises a periphery which deviates substantially from a mean periphery of net elements outside the partial region. In particular, as a result, a distribution of force in the safety net which is advantageous when under load, can be made possible, as a result of which, in particular, at least one trapping characteristic of the safety net for catching at least one dynamic impact body can be optimized. In addition, stability can also be advantageously increased. A "periphery" of a net element is to be understood, in particular, as an overall length, in particular of at least one winding, of the filament, closed per se, of which the net element consists. In the case of a ring, the periphery corresponds to a circle circumference. A "mean periphery" is to be understood, in particular, in this context, as a mean value of the peripheries, in particular of the overall lengths, in particular of the windings, of the filaments closed per se of which the net elements consist, of a random selection of a plurality of, preferably of all, net element/s of the safety net. A "substantial deviation" is to be understood, in particular, in this context, as a periphery of at least one net element deviating in the partial region by at least 50%, preferably by at least 30%, in a preferred manner by at least 20% and in a particularly preferred manner by at least 10% from the mean periphery of the net elements outside the partial region. In particular, all net elements of the partial region can comprise a substantially identical deviation. As an alternative to this, the net elements of the partial region comprise a different deviation at least in part. The net elements in the partial region are preferably at least in part greater by at least 10%, preferably greater by at least 20%, in a preferred manner greater by at least 30% or in a particularly preferred manner greater by at least 50% than the net elements outside the partial region. As an alternative to this or in addition to it, the net elements in the partial region can be at least in part smaller by at least 50%, preferably smaller by at least 30%, in a preferred manner smaller by at least 20% or in a particularly preferred manner smaller by at least 10% than the net elements outside the partial region.

It is additionally proposed that at least one net element of at least one partial region of the safety net, in particular of an exterior region of the safety net, which protrudes over the interior region, in particular over an overall extension of the interior region, in a direction parallel to a main extension direction of the safety net has in a test trial a tear resistance which deviates substantially from a mean tear resistance of net elements outside the partial region. As a result, in particular when under load, an advantageous distribution of force in the safety net can be made possible. Advantageously, a reaction of the net to an impact, in particular to an impact which is to be expected, can be optimized, as a result of which safety can be improved. A "tear resistance" is to be understood, in particular, as a maximum possible load of a net element prior to breaking the net element. The maximum load prior to breaking can preferably be measured in a test trial by means of a suitable test arrangement. In the test trial, an artificial load is exerted onto a test net element by means of the test arrangement. The test net element provides a net element which is identical to the net element arranged in the partial region. In particular, the test net element originates from a same production batch as the net element, in particular to take account of fluctuations in the quality of the material. An incremental increase in a load acting on the test net element brings about a deformation and/or breakage of the test net element at a certain force. The value of the minimum force necessary for breaking determines the tear resistance. A "mean tear resistance" is in particular to mean an average tear resistance of a plurality of test net elements of identical design and/or of an identical production batch. A "substantial deviation" is in particular to mean, in this context, a tear resistance of at least one net element in the partial region deviating by at least 500%, preferably by at least 300%, advantageously by at least 150%, in a preferred manner by at least 50% and in a particularly preferred manner by at least 10% from the mean tear resistance of net elements outside the partial region. In particular, all net elements of the partial region can comprise a substantially identical deviation. As an alternative to this, the tear resistances of the net elements of the partial region comprise different deviations at least in part. The net elements in the partial region preferably have at least in part a tear resistance which is greater by at least 10%, preferably greater by at least 50%, advantageously greater by at least 150%, in a preferred manner greater by at least 300% or in a particularly preferred manner greater by at least 500% than a mean tear resistance of the net elements outside the partial region. As an alternative to this or in addition to it, the tear resistance of the net elements in the partial region can be at least in part smaller by at least 500%, preferably smaller by at least 300%, advantageously smaller by at least 150%, in a preferred manner smaller by at least 50% or in a particularly preferred manner smaller by at least 10% than a mean tear resistance of the net elements outside the partial region.

It is additionally proposed that at least one net element, in particular of at least one partial region of the safety net, which protrudes over the interior region in a direction parallel to a main extension direction of the safety net comprises a predetermined breaking point, as a result it is advantageously possible to guide a force in a targeted manner in the case of an impact. In addition, uncontrolled tearing of the safety net can be avoided in an advantageous manner A predetermined breaking point can be realized, in particular, as a point with a thinner material thickness compared to the rest of the net element, as a preloaded point, for example as a result of manual bending back and forth and/or as a point with a material composition which deviates from the rest of the net element.

It is also proposed that at least one net element of at least one partial region of the safety net, in particular an outer region of the safety net, which protrudes over the interior region, in particular over an overall extension of the interior region, in a direction parallel to a main extension direction of the safety net, at least has a material composition which differs substantially from an, in particular mean, material composition of the net elements outside the partial region. In particular, as a result, a distribution of force in the safety net which is advantageous when under load, can be made possible, as a result of which, in particular, at least one trapping characteristic of the safety net for catching at least one dynamic impact body can be optimized. In addition, stability can also be advantageously increased. A material composition "differing substantially" from another material composition, is in particular to mean that the net elements in the partial region at least have a material composition in which a mass fraction of an atomic and/or molecular main component deviates by at least 0.1% by weight, preferably by at least 0.5% by weight, advantageously by at least 1% by weight, in a preferred manner by at least 10% by weight or in a particularly preferred manner by at least 99% by weight from a mass fraction of the same molecule and/or atom in the, in particular mean, material composition of the net elements outside the partial region. An "atomic and/or molecular main component" is to be understood, in particular, as an element and/or molecule which, in the case of a production, is added in a targeted manner to a material, in particular with the aim of influencing at least one material characteristic. It is conceivable, in particular, for a net element to consist of different components with various materials. Advantageously, a net element, in particular in the partial region, could comprise a coating, for example of plastics material. It is additionally conceivable for at least one net element to include a plurality of wire strands. The wire strands can be realized from identical wires of the same material. As an alternative to this, the wire strands can be realized, at least in part from different wires, in particular with various material compositions.

It is additionally proposed that at least one net element of at least one partial region of the safety net, in particular an outer region of the safety net, which protrudes over the interior region, in particular over an overall extension of the interior region, in a direction parallel to a main extension direction of the safety net, comprises at least one wire winding, in particular a wire strand winding, the wire diameter of which is substantially greater than a mean wire diameter of wire windings, in particular wire strand windings, of net elements outside the partial region. In particular, as a result, a distribution of force in the safety net which is advantageous when under load, can be made possible, as a result of which, in particular, at least one trapping characteristic of the safety net for catching at least one dynamic impact body can be optimized. In addition, stability can also be advantageously increased. A "wire winding" is to be understood, in particular, as at least part of a filament, in particular of a wire, which describes a periphery of a net element precisely once. A "wire strand winding" is to be understood, in particular, as at least part of a wire strand which describes a periphery of a net element precisely once. A "mean wire diameter" is to be understood, in particular, as a mean value of the wire diameter, in particular in a perpendicular cross section through the wire, of a random selection of a plurality of, of preferably all, net elements of the safety net, in particular outside the partial region. The wire diameter is preferably a diameter of a smallest circle which can be placed around a cross section of a filament, in particular of a wire, and in this case, surrounds the filament, in particular the wire, completely. A "mean wire strand diameter" is to be understood, in particular, as a mean value of the wire strand diameter, in particular in a perpendicular cross section through the wire strand, of a random selection of a plurality of, of preferably all, net elements of the safety net, in particular outside the partial region. The wire strand diameter is preferably a diameter of a smallest circle which can be placed around a cross section of a wire strand and in this case, surrounds all the wire windings completely. The term "substantially greater" is to be understood in this context, in particular, as a diameter being greater by at least 10%, preferably by at least 20%, advantageously by at least 30%, in a preferred manner by at least 50% and in a particularly preferred manner by at least 100%.

It is additionally proposed that at least one net element of at least one partial region of the safety net, in particular an outer region of the safety net, which protrudes over the interior region, in particular over an overall extension of the interior region, in a direction parallel to a main extension direction of the safety net, comprises at least a number of wire windings, in particular wire strand windings, which deviates substantially from a mean number of wire windings, in particular wire strand windings, of net elements outside the partial region. In particular, as a result, a distribution of force in the safety net which is advantageous when under load, can be made possible, as a result of which, in particular, at least one trapping characteristic of the safety net for catching at least one dynamic impact body can be optimized. In addition, stability can also be advantageously increased. A "mean number of wire windings" is to be understood, in particular, as a mean value of the number of wire windings of a random selection of a plurality of, preferably of all, net elements of the safety net, in particular outside the partial region. A "mean number of wire strand windings" is to be understood, in particular, as a mean value of the number of wire strand windings of a random selection of a plurality of, preferably of all, net elements of the safety net, in particular outside the partial region. A "substantial deviation" is to be understood in this context, in particular, as a number of wire windings, in particular wire strand windings, of at least one net element in the partial region deviating at least 200%, preferably at least 100%, in a preferred manner at least 50% and in a particularly preferred manner at least 10% from the mean number of wire windings, in particular wire strand windings, outside the partial region. In particular, all net elements of the partial region can comprise a substantially identical deviation. As an alternative to this, the net elements of the partial region comprise at least in part a different deviation. The number of wire windings, in particular wire strand windings, of the net elements in the partial region is preferably at least in part greater by at least 10%, preferably greater by at least 50%, in a preferred manner greater by at least 100% and in a particularly preferred manner greater by at least 200% than the number of wire windings, in particular wire strand windings, of the net elements outside the partial region. As an alternative to this or in addition to it, the number of wire windings, in particular of wire strand windings, in the partial region can be at least in part smaller by at least 200%, preferably smaller by at least 100%, in a preferred manner smaller by at least 50% or in a particularly preferred manner smaller by at least 10% than the number of wire windings, in particular of wire strand windings, of the net elements outside the partial region.

It is additionally proposed that at least one net element of at least one partial region of the safety net, in particular an outer region of the safety net, which protrudes over the interior region, in particular over an overall extension of the interior region, in a direction parallel to a main extension direction of the safety net, comprises at least one energy absorber. In particular, as a result, a distribution of force in the safety net which is advantageous when under load, can be made possible, as a result of which, in particular, at least one trapping characteristic of the safety net for catching at least one dynamic impact body can be optimized. In addition, stability can also be advantageously increased. An "energy absorber" is to be understood, in particular as an element which is provided for the purpose of converting at least part of a kinetic energy of a dynamic impact body, in particular when the dynamic impact body impacts into the safety net, into at least one energy form which differs from the kinetic energy, for example a potential energy and/or thermal energy, in particular deformation energy and/or inner friction. An energy absorber which can include, in particular, at least one torsion spring, can be arranged, in particular, between at least two net elements and or between at least one net element and at least one suspension, for example a cable.

It is additionally proposed that the energy absorber is realized integrally with the at least one net element. As a result, a simple design, in particular of the energy absorber, can advantageously be made possible. In addition, simple assembly and/or integration of the energy absorber into the safety net can advantageously be made possible. In particular, the energy absorber can be realized as a net element which, at least in part, is wavy and/or wrinkled and in particular is provided for the purpose of stretching under load. As an alternative to this, it is conceivable for at least part of a net element to be bent in the form of a torsion spring and/or to be replaced by a torsion spring.

It is also proposed that at least one net element, in particular a net element in at least one partial region of the safety net, preferably an outer region of the safety net, which protrudes over the interior region, in particular over an overall extension of the interior region, in a direction parallel to a main extension direction of the safety net, realizes precisely three connection regions to neighboring net elements. As a result, an advantageous design of the safety net, in particular, can be made possible, as a result of which safety can be advantageously increased, in particular with regard to catching dynamic impact bodies in the safety net. By means of the advantageous design, a catch area, in which dynamic impact bodies are able to be reliably trapped, can be advantageously enlarged, in particular by the catch area being able to be kept advantageously large after an impact of the dynamic impact body. A "connection region" is to be understood, in particular, as a region of a net element and/or of a net member, in particular of a bundle of net elements which are located one above another in a concentric manner in a safety net, in which the net element and/or the net member, in particular the bundle of net elements, in particular in a ready-assembled safety net, overlaps with at least one neighboring net element and/or at least one neighboring net member and/or at least one bundle of net elements. The net element and/or the neighboring net element can be realized, in particular, as a single net element and/or as a net member, in particular as a bundle of net elements. The net element and/or the net member, in particular the bundle of net elements, preferably overlaps in the connection region with precisely one net element and/or with precisely one net member, in particular precisely with one bundle of net elements. At least two of the connection regions, in particular with the safety net in a spread-out state, are preferably arranged located diametrically opposite one another relative to the net element. In particular, the connection regions each comprise a center of gravity. The centers of gravity of the connection regions, when seen from a center point of the net element comprising the precisely three connection regions, in particular with the safety net in a spread-out state, are arranged with respect to one another at an angle greater than 30°, preferably greater than 45°, advantageously greater than 60°, in a preferred manner greater than 75° and in a particularly preferred manner greater than 85°. In particular, each connection region of a net element is realized without overlap to each further connection region of the net element. At least one further net element of the safety net which is neighboring the net element with the precisely three connection regions, preferably comprises, in particular with the safety net in a totally spread-out state, precisely three connection regions. At least two additional further net elements of the safety net neighboring the net element with the precisely three connection regions, comprise, in a preferred manner, in particular with the safety net in a totally spread-out state, precisely three connection regions.

Further proposed is a net and rope construction with at least one safety net according to the invention. As a result, a high degree of safety and/or advantageous behavior in the event of an impact can advantageously be achieved. The net and rope construction is preferably a wire net and wire rope structure. The net and rope construction can be, for example, a rockfall protection installation, a motorsport barrier, a catchment fence, a road safety net and/or rail safety net, an avalanche net, a bullet catch net, a vehicle safety fence, in particular an aircraft safety fence, a test track safety net or the like.

The net and rope construction advantageously comprises at least one guide rope which is guided through at least every third, preferably every other, in a preferred manner each net element of a row of net elements which extends parallel to a main extension direction of the safety net on at least one outer edge of the safety net. The guide rope advantageously determines a degree of freedom of movement of the net elements. As a result, in particular in the event of impact, advantageous cushioning of the impact can be made possible, in particular as a result of displacing at least part of the net elements of the safety net in a directed manner. The guide rope is realized in particular as a wire rope. The guide rope is connected, in particular, to at least one support, preferably to at least two supports, of the net and cable construction. In particular, the support is provided for holding and/or suspension of the safety net. The support can preferably be fastened on at least one side to a substrate and/or to a wall, preferably a rock wall. In a particularly preferred manner, a main extension of the support extends in a state fastened to the substrate and/or to the wall, preferably a rock wall, in particular from a fastening point, substantially perpendicularly to a direction of the force of gravity. The term "at least every third" is to be understood, in particular, as in the row of neighboring net elements, in particular on the outer edge of the safety net, each net element which is devoid of the guide rope being passed through it, comprises no more than one neighboring net element of the row which is also devoid of the guide rope being passed through it. In particular, the row of net elements is devoid of three consecutive neighboring net elements which are devoid of the guide rope being passed through them. The term "at least every other" is to be understood, in particular, as in the row of neighboring net elements, in particular on the outer edge of the safety net, each net element which is devoid of the guide rope being passed through it, comprises exclusively neighboring net elements of the row through which the guide rope is passed. In particular, the row of net elements is devoid of two consecutive neighboring net elements which are devoid of the guide rope being passed through them. The outer edge of the safety net is realized, in particular, by a side of the outermost row of net elements which is devoid of neighboring net elements. The net and rope construction preferably comprises at least one guide rope on at least two outer edges which differ from one another.

It is additionally proposed that the guide rope is realized as at least one support rope which is provided, in particular, for the purpose of bearing the safety net and/or in the event of a load, in particular as a result of rubble and/or at least one further dynamic impact body, to absorb at least a substantial part of the load and/or to transmit it, preferably to at least one support. As a result, a simple design can advantageously be achieved, in particular by it being possible to dispense with additional guide rope, running cable and/or further additional suspensions. As a result, costs, in particular assembly costs and/or material costs, can be advantageously saved. The support rope is preferably realized as a wire rope. It is conceivable, in addition, for the support rope to be realized as a cable bundle which consists of at least two support ropes, as a result of which safety and/or stability can be further improved.

The safety net according to the invention can be advantageously used in the net and rope construction as a catch net. The net and rope construction preferably includes a plurality of safety nets which are connected together, in particular by means of cables, preferably support ropes, and/or by means of shackles.

The safety net according to the invention is not to be restricted, in this connection, to the above-described application and embodiment. In particular, the safety net according to the invention, for fulfilling an operating principle described herein, is able to comprise a number of individual elements, components and units which deviates from a number named herein.

DRAWINGS

Further advantages are produced from the following description of the drawing. Six exemplary embodiments of the invention are shown in the drawings. The drawings, the description and the claims include numerous features in combination. The expert will also look at the features individually in an expedient manner and combine them to form sensible further combinations. In addition, in the case of the value ranges specified in said disclosure, values also lying within the named limits apply as disclosed and as arbitrarily applicable.

Figure 4B:
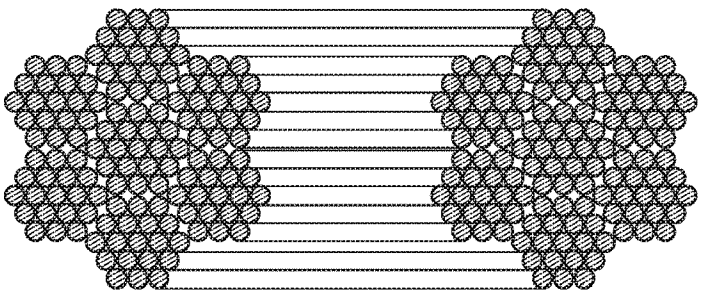
Figure 4A:
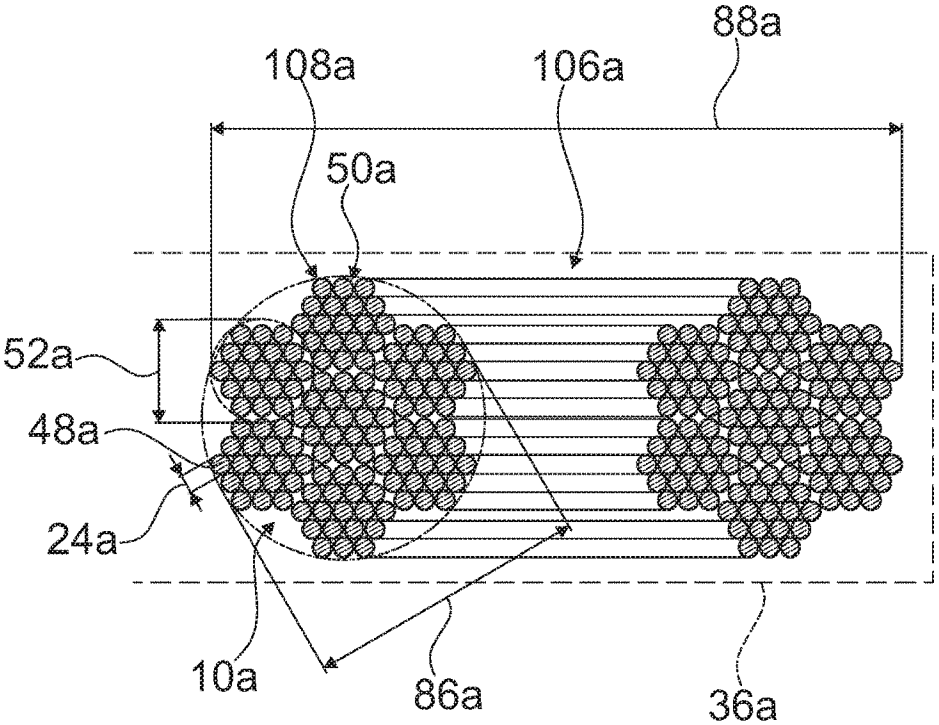
Figure 5:
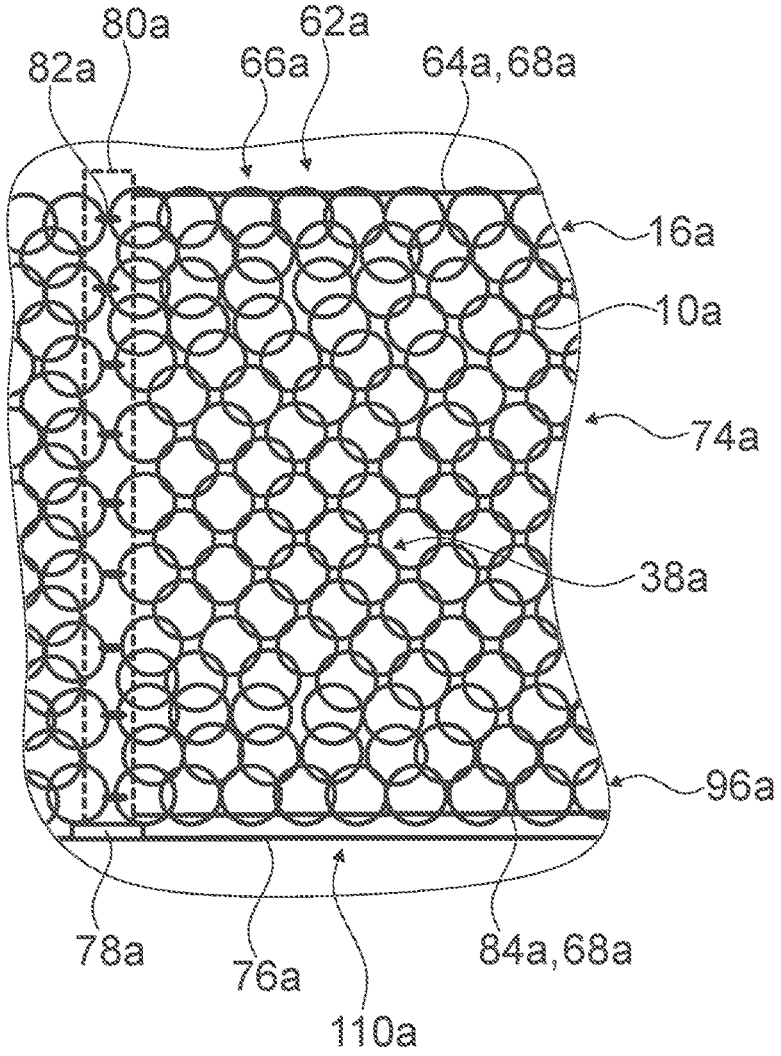
Figure 6:
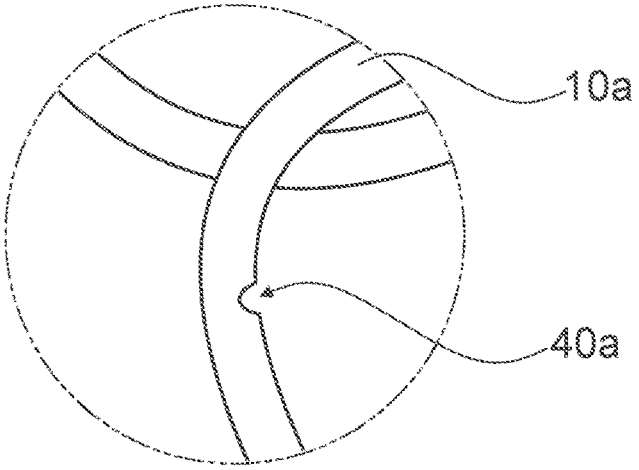
Figure 7:
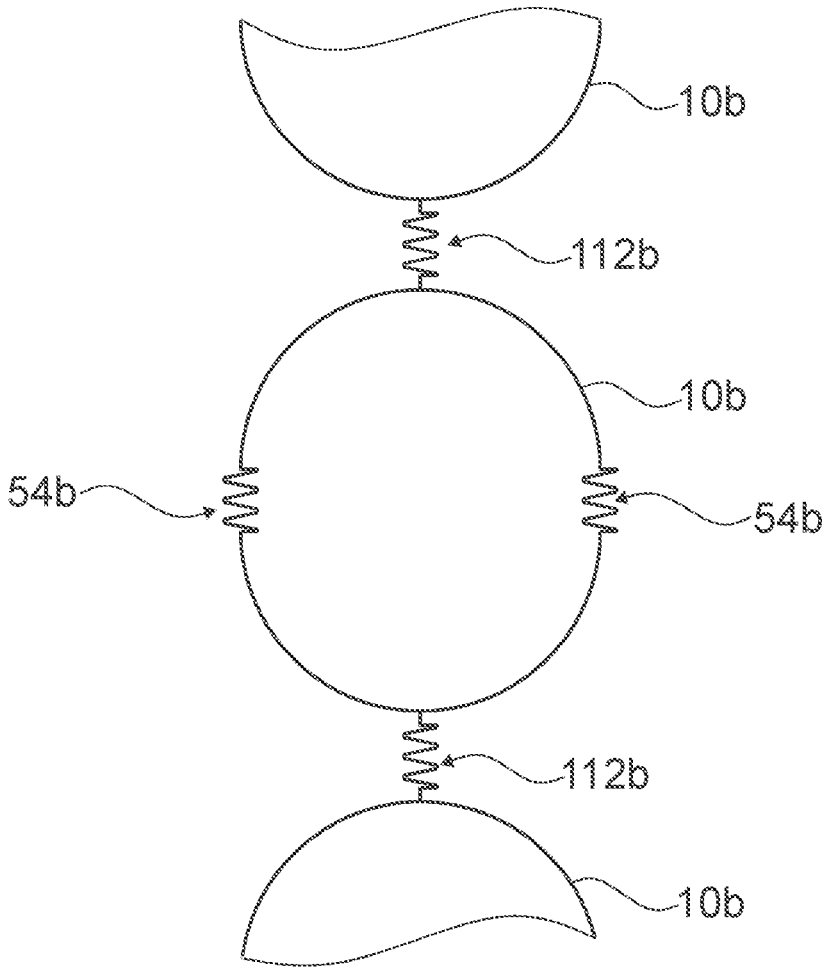
Figure 8B:
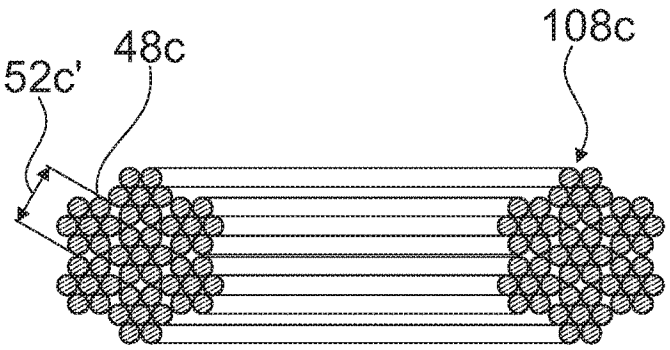
Figure 8A:
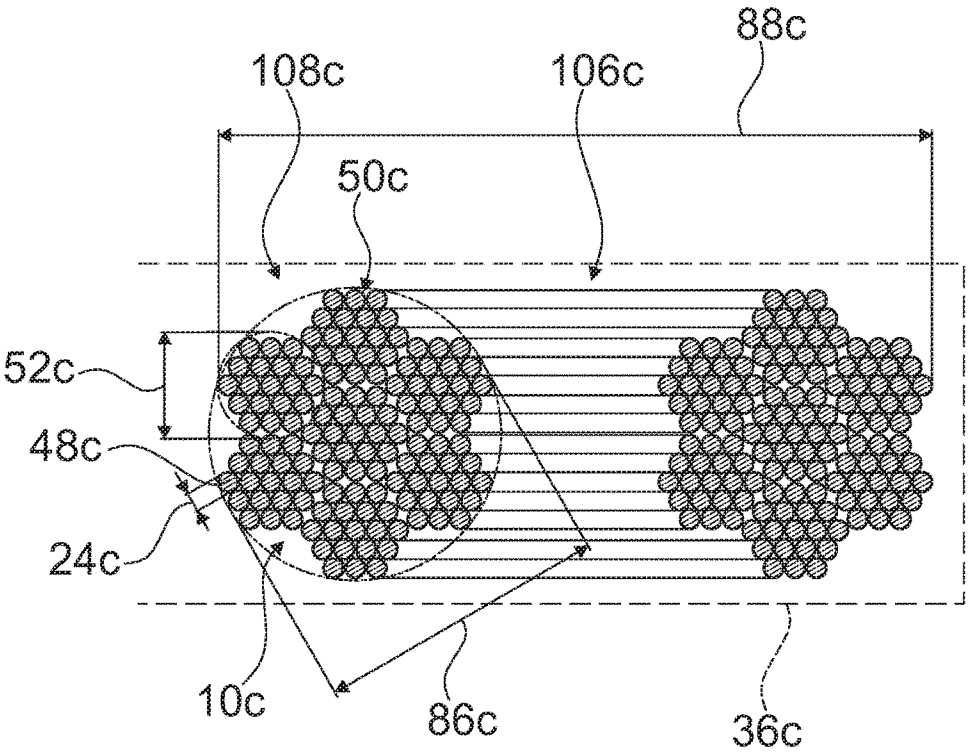
Figure 9B:
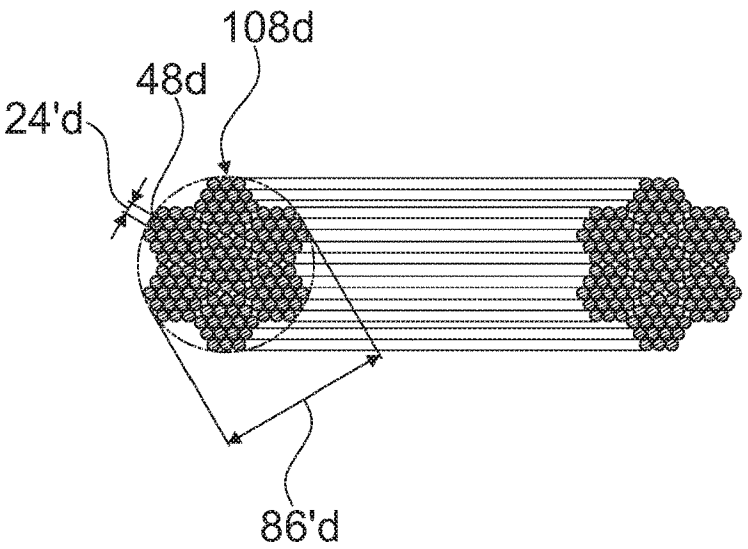
Figure 9A:
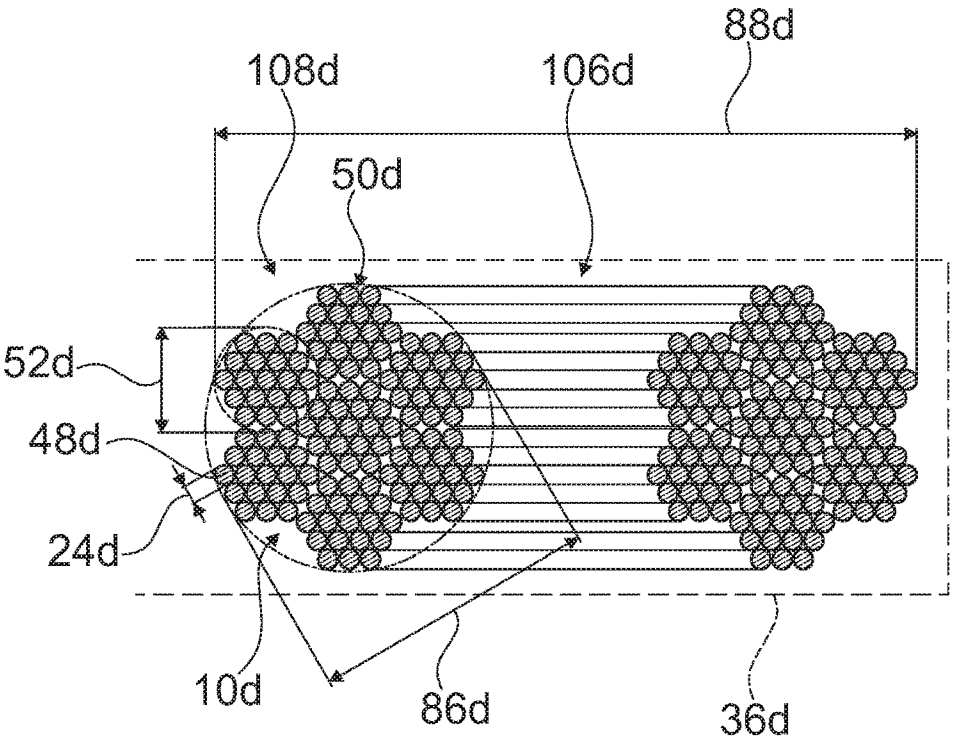
Figure 10B:
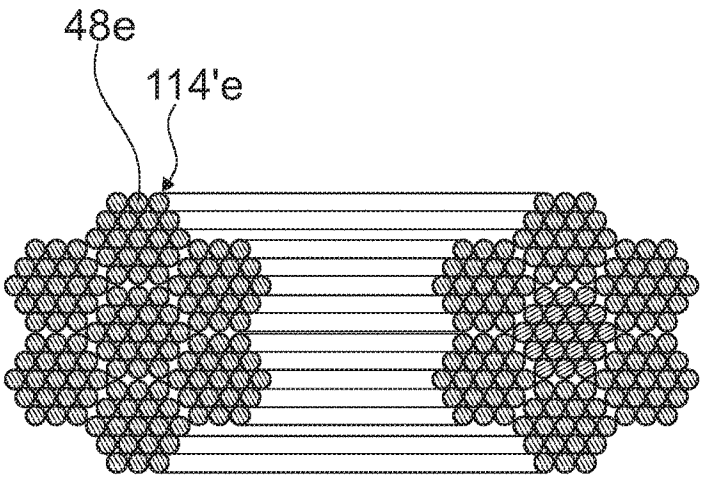
Figure 10A:
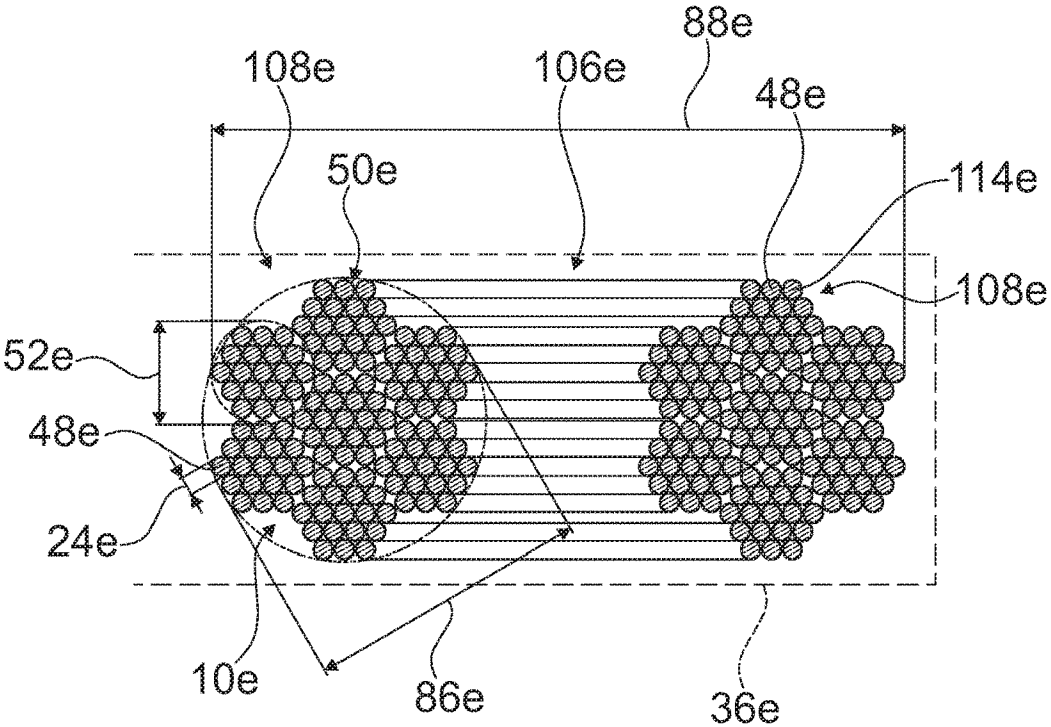
Figure 11:
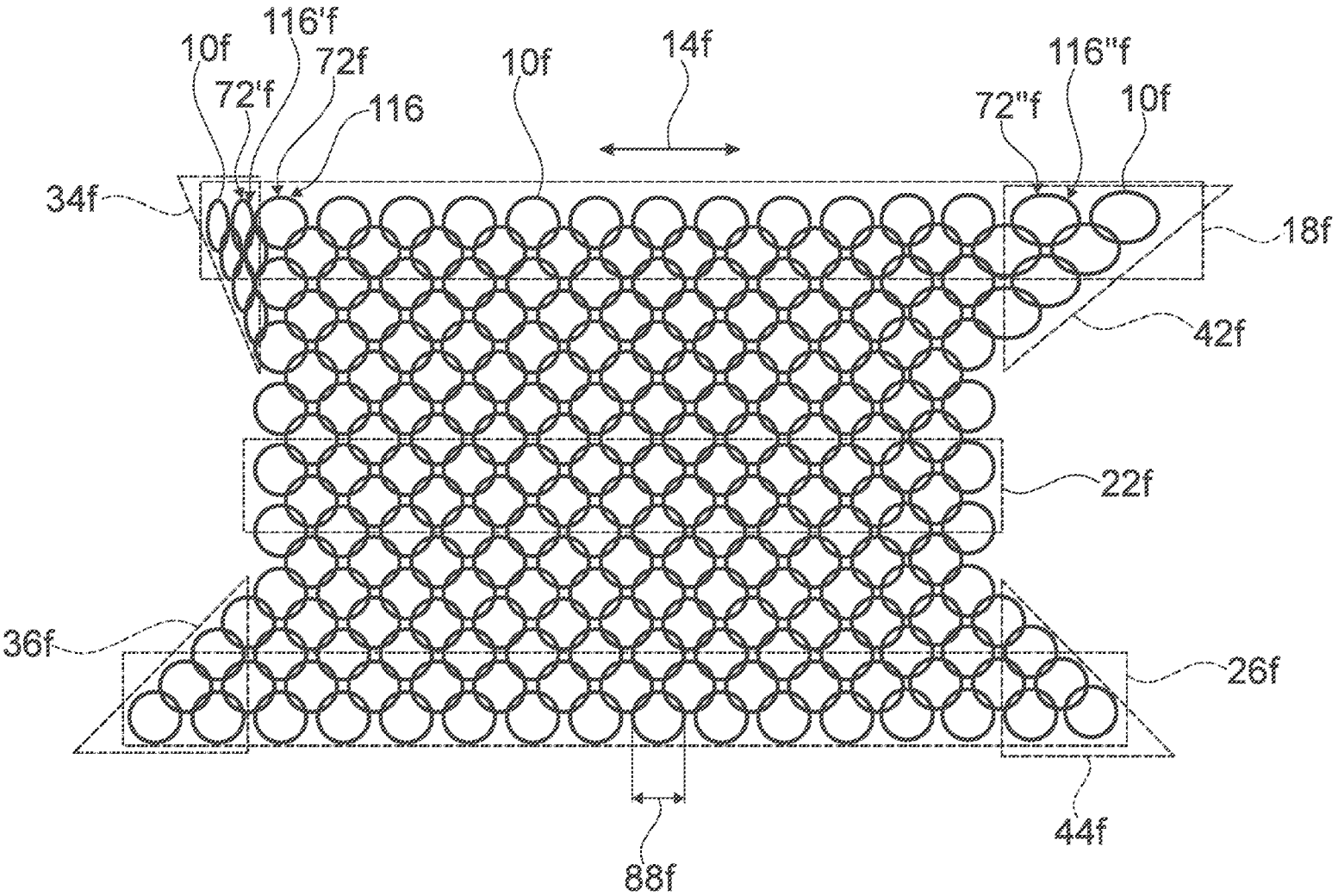

FIG. 4*a* shows a schematic sectional view through a net element of part of the safety net, FIG. 4*b* shows a schematic sectional view through a further net element of the part of the safety net, FIG. 5 shows a schematic top view of part of a net and rope construction with the safety net, FIG. 6 shows a schematic view of parts of net elements with a predetermined breaking point, FIG. 7 shows a schematic view of alternative net elements with energy absorbers, FIG. 8*a* shows a schematic sectional view through a net element of part of an alternative safety net, FIG. 8*b* shows a schematic sectional view through a further net element of the part of the alternative safety net, FIG. 9*a* shows a schematic sectional view through a net element of part of a further alternative safety net, FIG. 9*b* shows a schematic sectional view through a further net element of the part of the further alternative safety net, FIG. 10*a* shows a schematic sectional view through a net element of part of an additional further alternative safety net FIG. 10*b* shows a schematic sectional view through a further net element of the part of the additional further alternative safety net, and FIG. 11 shows a schematic top view of a second additional further alternative safety net.

DESCRIPTION OF THE EXEMPLARY EMBODIMENTS

Figure 1:
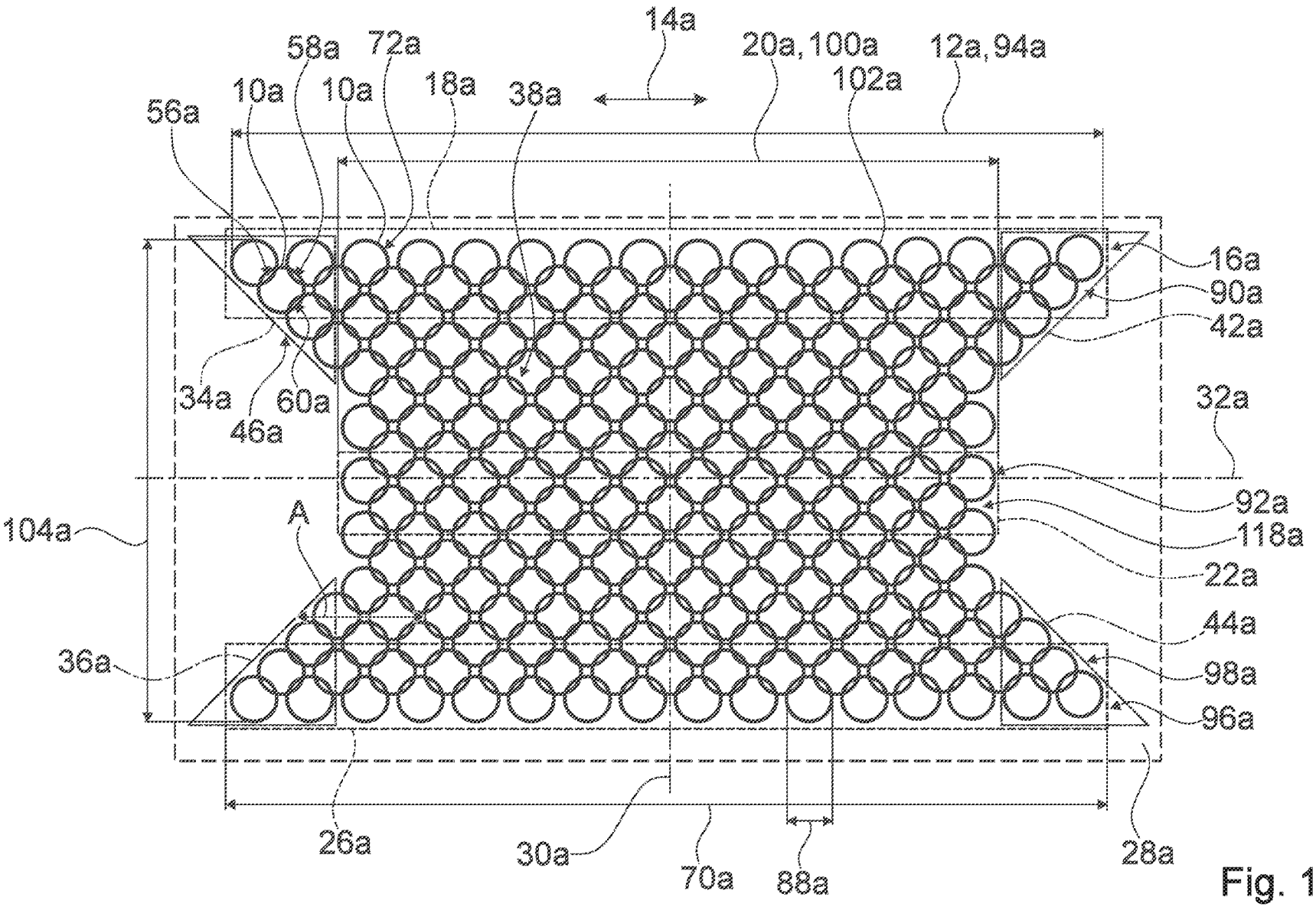
FIG. 1 shows a schematic top view of a safety net.

FIG. 1 shows a safety net. The safety net is spread out along a main extension plane 28*a*. The safety net serves for catching heavy loads. The safety net is formed from net elements 10*a*. The net elements 10*a* are realized as rings 102*a*. The net elements 10*a* are realized substantially identically. The net elements 10*a* comprise a net element diameter 88*a*. The net elements 10*a* engage in neighboring net elements 10*a*. Two interconnecting net elements 10*a* realize a connection region 56*a*, 58*a*, 60*a*. At least one net element 10*a* of the safety net realizes precisely three connection regions 56*a*, 58*a*, 60*a* to neighboring net elements 10*a*. The net elements 10*a* realize adjoining rows of net elements 10*a* perpendicularly to a main extension direction 14*a* of the safety net. The net elements 10*a* of a row are without overlap with respect to one another. Net elements 10*a* of one row overlap with net elements 10*a* of neighboring rows. Net elements 10*a* of one row engage in net elements 10*a* of neighboring rows. It is conceivable for at least one net element 10*a* to comprise a predetermined breaking point 40*a* (cf. FIG. 6).

The safety net comprises an exterior region 18*a*. The exterior region 18*a* includes an outermost row 16*a* of net elements 10*a*. The exterior region 18*a* includes two rows of net elements 10*a*. The exterior region 18*a* extends over all net elements 10*a* of an outermost row 16*a* of net elements 10*a*. The exterior region 18*a* extends over all net elements 10*a* of a further row 90*a* of net elements 10*a* which differs from the outermost row 16*a*. The safety net comprises a maximum overall extension 94*a*. The maximum overall extension 94*a* runs parallel to the main extension direction 14*a* of the safety net. The safety net comprises a maximum overall extension 12*a* which lies inside the exterior region 18*a*. The maximum overall extension 12*a* which lies inside the exterior region 18*a* and the maximum overall extension 94*a* of the safety net are identical to one another.

The safety net comprises a further exterior region 26*a*. The further exterior region 26*a* is realized differently from the exterior region 18*a*. The further exterior region 26*a* and the exterior region 18*a* are without overlap to one another. The further exterior region 26*a* extends over all net elements 10*a* of a further outermost row 96*a* of net elements 10*a*. The further exterior region 26*a* extends over all net elements 10*a* of an additional row 98*a* of net elements 10*a* which differs from the further outermost row 96*a*. The safety net comprises a maximum overall extension 70*a* lying inside the further exterior region 26*a*. The maximum overall extension 70*a* lying inside the further exterior region 26*a* and the maximum overall extension 94*a* of the safety net are identical to one another The safety net comprises an interior region 22*a*. The interior region 22*a* is without overlap to the exterior region 18*a* and to the further exterior region 26*a*. The interior region 22*a* includes an inner row 92*a* of net elements 10*a*. The interior region 22*a* includes a further inner row 118*a* of net elements 10*a* neighboring the inner row 92*a*. The inner row 92*a* lies in the center of the safety net. The inner row 92*a* lies between the outermost row 16*a* and the further outermost row 96*a*. The safety net comprises a minimum overall extension 100*a*. The minimum overall extension 100*a* runs parallel to the main extension direction 14*a* of the safety net. The safety net comprises a minimum overall extension 20*a* lying inside the interior region 22*a*. The minimum overall extension 20*a* lying inside the interior region 22*a* and the minimum overall extension 100*a* of the safety net are identical to one another. The maximum overall extension 12*a* lying inside the exterior region 18*a*, 26*a* and/or the maximum overall extension 94*a* is greater than the minimum overall extension 20*a* lying inside the interior region 22*a* and/or the minimum overall extension 100*a* of the safety net. The maximum overall extension 12*a* lying inside the exterior region 18*a*, 26*a* and/or the maximum overall extension 94*a* of the safety net is greater by at least a mean diameter of the net elements 10*a* of the safety net than the minimum overall extension 20*a* lying inside the interior region 22*a* and/or the minimum overall extension 100*a* of the safety net. In the exemplary embodiment shown in FIG. 1, the mean diameter of the net elements 10*a* corresponds to the net element diameter 88*a*. A difference in size between the maximum overall extension 12*a*, 94*a* and the minimum overall extension 20*a*, 100*a* is greater than four times the net element diameter 88*a*. It is conceivable for at least one net element 10*a* to comprise a predetermined breaking point 40*a* in the exterior region 18*a*, the further exterior region 26*a* and/or the interior region 22*a*.

The safety net comprises two mirror planes 30*a*, 32*a*. The mirror planes 30*a*, 32*a* are arranged perpendicularly to a main extension plane 28*a* of the safety net. One mirror plane 30*a* is perpendicular to the main extension direction 14*a*. One mirror plane 32*a* is parallel to the main extension direction 14*a*. The net elements 10*a* are arranged in a mirror-symmetrical manner with respect to the mirror planes 30*a*, 32*a*. The safety net comprises a constant overall extension 104*a* perpendicular to the main extension direction 14*a* in a direction lying in the main extension plane 28*a*.

Figure 2:
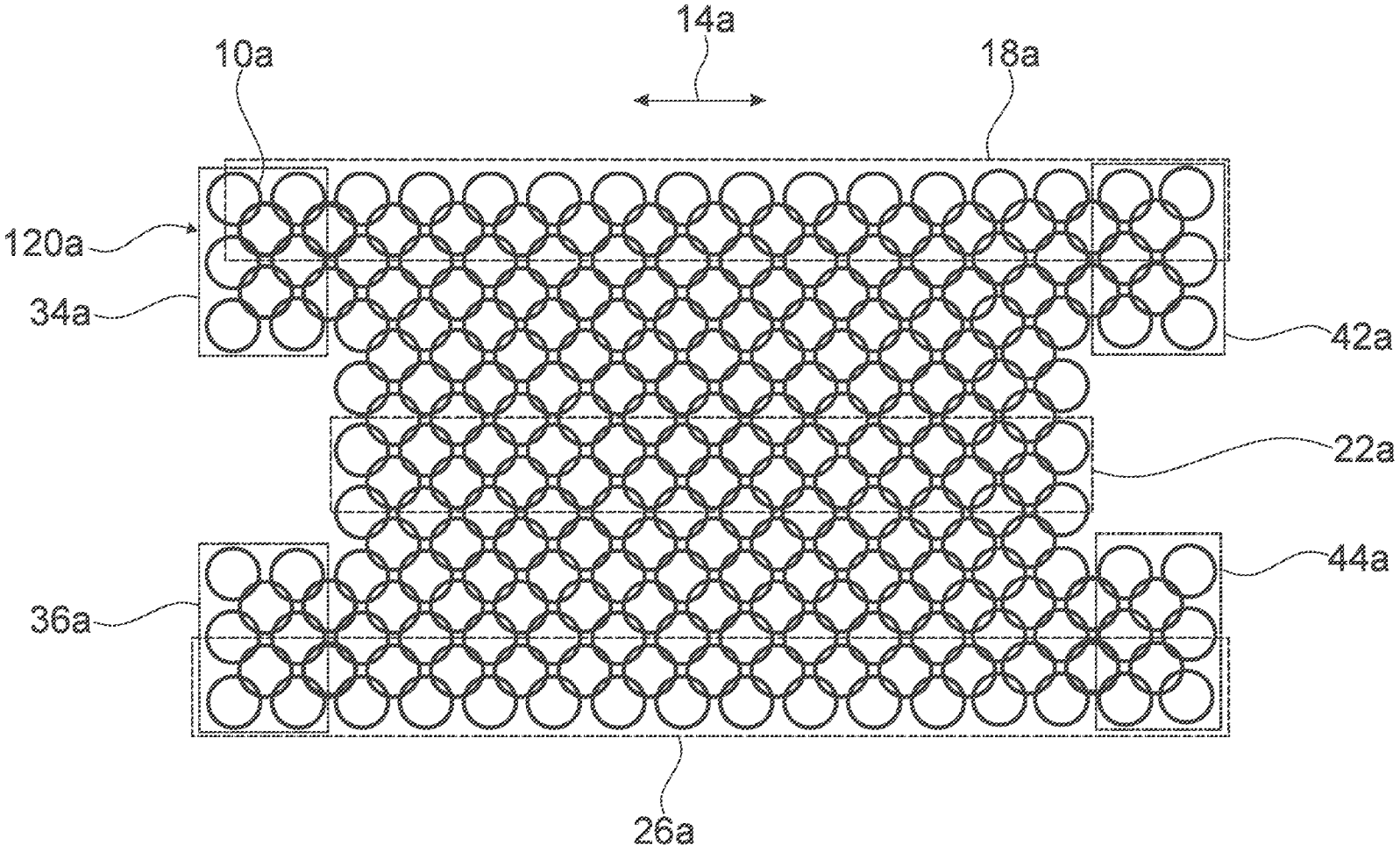
FIG. 2 shows a schematic top view of an alternative safety net.
Figure 3:
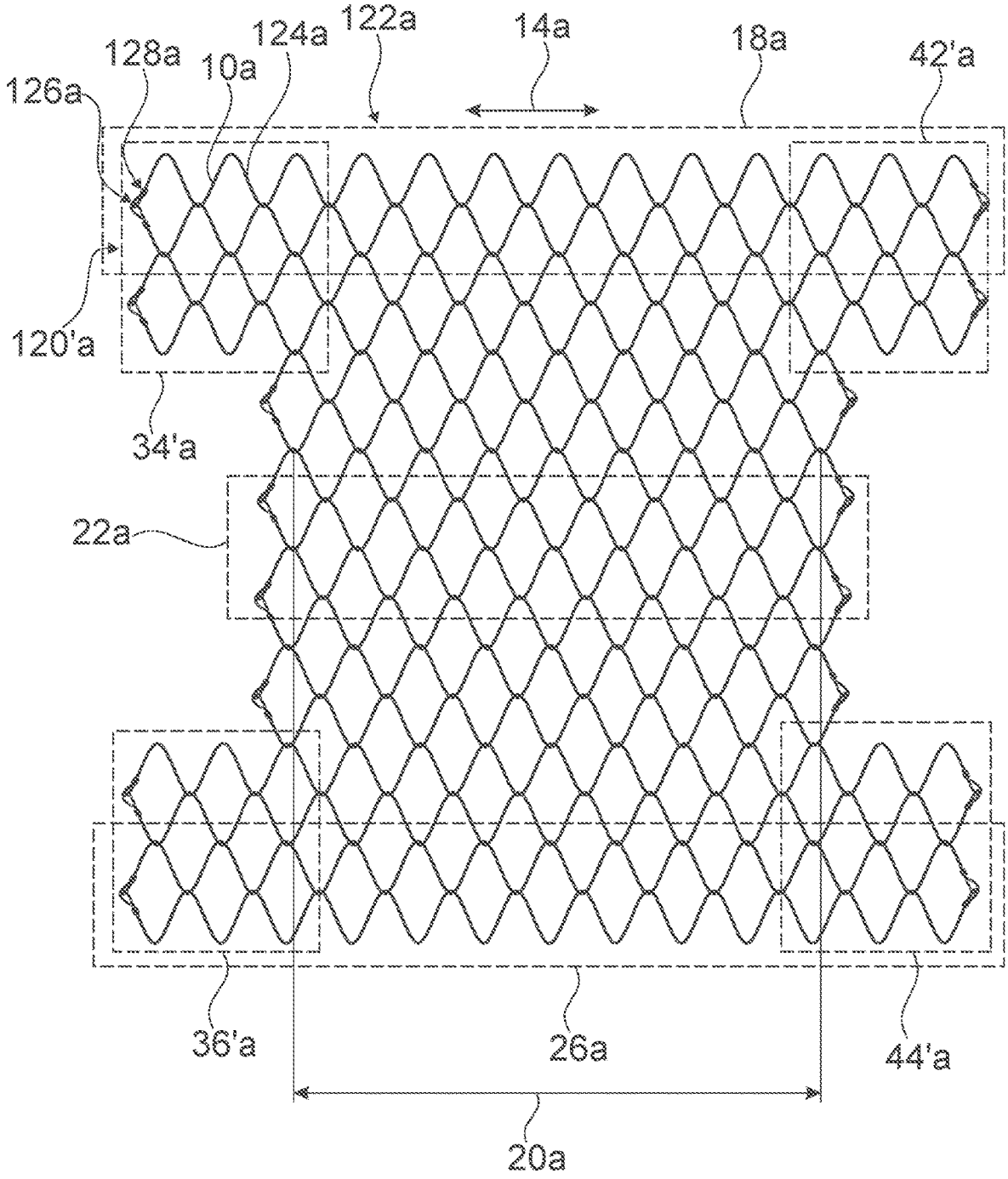
FIG. 3 shows a schematic top view of a further alternative safety net.

The safety net comprises four partial regions 34*a*, 36*a*, 42*a*, 44*a* which protrude over the minimum overall extension 20*a* of the interior region 22*a* in a direction parallel to a main extension direction 14*a* of the safety net. The partial region 34*a*, 36*a*, 42*a*, 44*a* comprises six net elements 10*a*. The partial region 34*a*, 36*a*, 42*a*, 44*a* of the safety net comprises a number of net elements 10*a*, which are arranged side by side in a row in the main extension direction 14*a* of the safety net, which corresponds to two seventeenths of a maximum number of all rows of net elements 10*a* arranged side by side perpendicularly to the main extension direction 14*a* of the safety net. The partial region 34*a*, 36*a*, 42*a*, 44*a* of the safety net comprises a number of net elements 10*a*, which are arranged side by side in a row perpendicularly to the main extension direction 14*a* of the safety net, which corresponds to two seventeenths of the maximum number of all rows of net elements 10*a* arranged side by side perpendicularly to the main extension direction 14*a* of the safety net. The partial region 34*a*, 36*a*, 42*a*, 44*a* of the safety net comprise a triangle-shaped arrangement 46*a* of net elements 10*a*. As an alternative to this, at least one of the partial regions 34*a*, 36*a*, 42*a*, 44*a* can comprise an arrangement which deviates from the triangle-shaped arrangement 46*a*, for example an at least rectangular arrangement 120*a* (cf. FIG. 2) and/or an at least partially polygonal arrangement. In a test trial, a net element 10*a* in the partial region 34*a*, 36*a*, 42*a*, 44*a* of the safety net has a tear resistance which deviates from a mean tear resistance of net elements 10*a* outside the partial region 34*a*, 36*a*, 42*a*, 44*a*. As an alternative to this, all net elements 10*a* can have a substantially identical tear resistance in the test trial. It is conceivable for at least one net element 10*a* to comprise a predetermined breaking point 40*a* in at least one of the partial regions 34*a*, 36*a*, 42*a*, 44*a*. As an alternative to this, the safety net can be realized as a mesh network 122*a* (cf. FIG. 3). The mesh network 122*a* is realized from mutually engaging helices 124*a*. At the ends, the helices 124*a* comprise at least one knot 128*a* which forms a loop 126*a*. Loops 126*a* of neighboring helices 124*a* mesh together. The safety net realized from helices 124*a* comprises four partial regions 34'*a*, 36'*a*, 42'*a*, 44'*a* which protrude over the minimum overall extension 20*a* of the interior region 22*a* in a direction parallel to a main extension direction 14*a* of the safety net. The partial regions 34'*a*, 36'*a*, 42'*a*, 44'*a* of the safety net realized from helices 122*a* comprise a rectangular arrangement 120'*a* of net elements 10*a*.

FIGS. 4*a* and 4*b* show a section through part of the safety net along a section axis A (cf. FIG. 1). The net element 10*a* shown in FIG. 4*a* lies inside the partial region 36*a*. The net element 10*a* shown in FIG. 4*b* lies outside the partial region 36*a*. The net elements 10*a* shown in FIGS. 4*a* and 4*b* are realized as wire ropes 106*a*. The net element 10*a* comprises a net element cross section diameter 86*a*. The net element cross section diameter 86*a* is constant over a periphery 72*a* of the net element 10*a*. The wire rope 106*a* comprises a plurality of wire windings 48*a*. The wire windings 48*a* comprise a wire diameter 24*a*. The wire diameter 24*a* is constant over the periphery 72 of the net element 10*a*. The net element cross section diameter 86*a* corresponds to a multiple of the wire diameter 24*a*. The net element 10*a* comprises a wire strand 108*a*. The wire strand 108*a* comprises 19 wire windings 48*a*. The wire strand 108*a* comprises a wire strand diameter 52*a*. The wire strand diameter 52*a* is constant over the periphery 72*a* of the net element 10*a*. The net element cross section diameter 86*a* corresponds to a multiple of the wire strand diameter 52*a*. The net element 10*a* comprises seven wire strand windings 50*a*.

FIG. 5 shows part of a net and rope construction 62*a* with the safety net. The safety net is used as a catch net 74*a* in the net and rope construction 62*a*. The catch net 74*a* is provided for catching a dynamic impact body in a catch area 38*a* of the catch net 74*a*. The catch net 74*a* is positioned such that a main impact direction of a dynamic impact body is perpendicular to the catch area 38*a*. The main impact direction of a dynamic impact body points into the image plane or out of the image plane in FIG. 5. The net elements 10*a* of the partial regions 34*a*, 36*a*, 42*a*, 44*a* are pushed together in the assembled, non-loaded state. Net elements 10*a* of the safety net lying on the outside in the main extension direction 14*a* comprise shackles 82*a* at least in part. Net elements 10*a* of the safety net are shackled by means of the shackles 82*a* with net elements 10*a* of a further neighboring safety net. The net and rope construction 62*a* comprises a support 80*a*. The net and rope construction 62*a* comprises a wall fastening element 78*a*. The wall fastening element 78*a* is provided for the purpose of fastening the support 80*a* to a wall 76*a*.

The net and rope construction 62*a* comprises a first guide rope 64*a*. The first guide rope 64*a* is arranged on a side of the safety net remote from the wall 76*a*, in particular from the wall fastening element 78*a*. The first guide rope 64*a* is arranged on a side of the support 80*a* remote from the wall 76*a*, in particular from the wall fastening element 78*a*. The first guide rope 64*a* is connected to the support 80*a*. The net and rope construction 62*a* comprises a second guide rope 84*a*. The second guide rope 84*a* is arranged on a side of the safety net remote from the wall 76*a*, in particular from the wall fastening element 78*a*. The second guide rope 84*a* is arranged on a side of the support 80*a* remote from the wall 76*a*, in particular from the wall fastening element 78*a*. The second guide rope 84*a* is connected to the support 80*a*.

The safety net comprises two outer edges 66*a*, 110*a* in a direction perpendicular to the main extension direction 14*a* of the safety net. The net elements 10*a* on the outer edges 66*a*, 110*a* form the two outermost rows 16*a*, 96*a*. The first guide rope 64*a* is guided through the net elements 10*a* of the outermost row 16*a*. The second guide rope 84*a* is guided through the net elements 10*a* of the further outermost row 96*a*. The first guide rope 64*a* is realized as a support rope 68*a*. The second guide rope 84*a* is realized as a support rope 68*a*.

FIGS. 7 to 11 show five further exemplary embodiments of the invention. The following descriptions and the drawings are restricted substantially to the differences between the exemplary embodiments, reference also being possible, in principle, to the drawings and/or the description of the other exemplary embodiments, in particular of FIGS. 1 to 6, with regard to identically designated components, in particular with regard to components with identical reference symbols. To differentiate between the exemplary embodiments, the letter a is placed after the reference symbol of the exemplary embodiment in FIGS. 1 to 6. The letter a is replaced by the letters b to f in the exemplary embodiments in FIGS. 7 to 11.

FIG. 7 shows a net element 10*b*. The net element 10*b* comprises an energy absorber 54*b*. The energy absorber 54*b* is realized integrally with the net element 10*b*. The energy absorber 54*b* is realized as a wavy region of the net element 10*b*. As an alternative to this, the energy absorber 54*b* could be realized as an, in particular helically, twisted region of the net element 10*b* and/or as a region with a material, in particular a highly resilient material, which deviates from the rest of the net element 10*b*. The net element 10*b* comprises a further energy absorber 112*b*. The further energy absorber 112*b* is realized separately from the net element 10*b*. The further energy absorber 112*b* is arranged between two neighboring, non-overlapping net elements 10*b*. The further energy absorber 112*b* is realized as a highly resilient, curved element. The net element 10*b* with the energy absorbers 54*b*, 112*b* is arranged in a partial region 34*b*, 36*b*, 42*b*, 44*b* of the safety net. As an alternative to this, it is conceivable for the net element 10*b* with the energy absorbers 54*b*, 112*b* to be arranged in a region of the safety net which differs from the partial region 34*b*, 36*b*, 42*b*, 44*b*, for example an interior region 22*b* and/or a region of an exterior region 18*b*, 26*b* of the safety net which differs from the partial region 34*b*, 36*b*, 42*b*, 44*b*.

The detail of a safety net shown in sectional views in FIGS. 8*a* and 8*b* shows two net elements 10*c*. The net element 10*c* shown in FIG. 8*a* lies inside the partial region 36*c*. The net element 10*c* shown in FIG. 8*b* lies outside the partial region 36*c*. The net element 10*c* inside the partial region 36*c* comprises a number of wire windings 48*c* which deviates from the number of wire windings 48*c* of the net element 10*c* outside the partial region 36*c*. The net element 10*c* inside the partial region 36*c* comprises a greater number of wire windings 48*c* than the net element 10*c* outside the partial region 36*c*. As an alternative to this, it is conceivable for the net element 10*c* inside the partial region 36*c* to comprise a smaller number of wire windings 48*c* than the net element 10*c* outside the partial region 36*c*. The net element 10*c* comprises a wire strand 108*c*. The wire strand 108*c* comprises a plurality of wire strand windings 50*c*. The wire strand winding 50*c* comprises a wire strand diameter 52*c*. The wire strand diameter 52*c* of the net element 10*c* in the partial region 36*c* is greater than a wire strand diameter 52'*c* of a net element 10*c* outside the partial region 36*c*. As an alternative to this, the wire strand diameter 52*c* of the net element 10*c* in the partial region 36*c* could be greater than the wire strand diameter 52'*c* of the net element 10*c* outside the partial region 36*c*.

The detail of a safety net shown in sectional views in FIGS. 9*a* and 9*b* shows two net elements 10*d*. The net element 10*d* shown in FIG. 9*a* lies inside a partial region 36*d* of the safety net. The net element 10*d* shown in FIG. 9*b* lies outside a partial region 36*d*. The net element 10*d* comprises a wire winding 48*d*. The wire winding 48*d* comprises a wire diameter 24*d*. The wire diameter 24*d* of a wire winding 48*d* inside the partial region 36*d* is greater than a mean wire diameter 24'*d* of wire windings 48*d* of net elements 10*d* outside the partial region 36*d*. As an alternative to this, it is conceivable for the net element 10*d* inside the partial region 36*d* to comprise a smaller wire diameter 24*d* of the wire winding 48*d* than the net element 10*d* outside the partial region 36*d*. The net element 10*d* comprises a net element cross section diameter 86*d*. The net element cross section diameter 86*d* of the net element 10*d* inside the partial region 36*d* is greater than a net element cross section diameter 86'*d* of a net element 10*d* outside the partial region 36*d*. As an alternative to this, the net element cross section diameter 86*d* of the net element 10*d* inside the partial region 36*d* could be smaller than the net element cross section diameter 86'*d* of the net element 10*d* outside the partial region 36*d*.

The detail of a safety net shown in sectional views in FIGS. 10*a* and 10*b* shows two net elements 10*e*. The net element 10*e* shown in FIG. 10*a* lies inside a partial region 36*e* of the safety net. The net element 10*e* shown in FIG. 10*b* lies outside a partial region 36*e*. The net element 10*e* in the partial region 36*e* has a material composition 114*e*. The material composition 114*e* of net elements 10*e* in the partial region 36*e* is different to a material composition 114'*e* of the net elements 10*e* outside the partial region 36*e*.

FIG. 11 shows a safety net with net elements 10*f*. The net elements 10*f* comprise a periphery 72*f*. The net elements 10*f* comprise an outer form 116*f*. A periphery 72'*f*, 72"*f* of a net element 10*f* inside a partial region 34*f*, 42*f* of the safety net deviates substantially from a mean periphery 72*f* of net elements 10*f* outside the partial region 34*f*, 42*f*. The periphery 72'*f* of a net element 10*f* in the partial region 34*f* is smaller than the periphery 72*f*, 72"*f* of a net element 10*f* outside the partial region 34*f*. The periphery 72"*f* of a net element 10*f* in the partial region 42*f* is greater than the periphery 72*f*, 72'*f* of a net element 10*f* outside the partial region 42*f*. An outer form 116'*f*, 116"*f* of a net element 10*f* in the partial region 34*f*, 42*f* deviates substantially from a mean outer form 116*f* of the net elements 10*f* outside the partial region 34*f*, 42*f*.

The invention claimed is:

1. A safety net, in particular for catching heavy loads, preferably dynamic impact bodies, in particular rocks, wherein the safety net is formed by mutually engaging net elements, which form separable base elements of the safety net and which are realized as closed wire structures, wherein a maximum overall extension of the safety net parallel to a main extension direction of the safety net is substantially greater in an exterior region of the safety net, which includes at least one outermost row of net elements, than a minimum overall extension of the safety net parallel to the main extension direction in an interior region of the safety net which differs from the exterior region, and wherein at least one partial region of the safety net which protrudes over the interior region in a direction parallel to the main extension direction of the safety net comprises at least a plurality of net elements, which are provided to give way when the safety net is loaded in order to create an additional buffer path on at least one outer edge of the safety net at which the safety net is to be suspended.

2. The safety net as claimed in claim 1, wherein the maximum overall extension of the safety net parallel to the main extension direction of the safety net is greater in the exterior region at least by a mean diameter of the net elements of the safety net than the minimum overall extension of the safety net parallel to the main extension direction in the interior region which differs from the exterior region.

3. The safety net as claimed in claim 1, wherein a maximum overall extension of the safety net parallel to the main extension direction of the safety net is greater in a further exterior region of the safety net which differs from the exterior region than the minimum overall extension of the safety net parallel to the main extension direction in the interior region of the safety net which differs from the exterior region and from the further exterior region.

4. The safety net as claimed in claim 1, wherein the net elements are arranged in a mirror-symmetrical manner with respect to a mirror plane, which is at least substantially perpendicular to a main extension plane of the safety net.

5. The safety net as claimed in claim 1, wherein at least one partial region of the safety net, which protrudes over the interior region in a direction parallel to a main extension direction of the safety net, comprises a number of net elements arranged side by side in a row in the main extension direction of the safety net, which corresponds to at least a twentieth of a maximum number of all rows of net elements arranged side by side perpendicularly to the main extension direction of the safety net.

6. The safety net as claimed in claim 1, wherein at least one partial region of the safety net, which protrudes over the interior region in a direction parallel to a main extension direction of the safety net, comprises a number of net elements arranged side by side in a row perpendicularly to the main extension direction of the safety net, which corresponds to at least a tenth of a maximum number of all rows of net elements arranged side by side perpendicularly to the main extension direction of the safety net.

7. The safety net as claimed in claim 1, wherein at least one partial region of the safety net, which protrudes over the interior region in a direction parallel to a main extension direction of the safety net, comprises an at least substantially triangle-shaped arrangement of net elements.

8. The safety net as claimed in claim 1, wherein at least one net element of at least one partial region of the safety net, which protrudes over the interior region in a direction parallel to a main extension direction of the safety net, comprises a periphery which deviates substantially from a mean periphery of net elements outside the partial region.

9. The safety net as claimed in claim 1, wherein at least one net element of at least one partial region of the safety net, which protrudes over the interior region in a direction parallel to a main extension direction of the safety net, has in a test trial a tear resistance which deviates substantially from a mean tear resistance of net elements outside the partial region.

10. The safety net as claimed in claim 1, wherein at least one net element comprises a predetermined breaking point.

11. The safety net as claimed in claim 1, wherein at least one net element of at least one partial region of the safety net, which protrudes over the interior region in a direction parallel to a main extension direction of the safety net, at least has a material composition which differs substantially from a material composition of the net elements outside the partial region.

12. The safety net as claimed in claim 1, wherein at least one net element of at least one partial region of the safety net, which protrudes over the interior region in a direction parallel to a main extension direction of the safety net, comprises at least one wire winding, the wire diameter of which is substantially greater than a mean wire diameter of wire windings of net elements outside the partial region.

13. The safety net as claimed in claim 1, wherein at least one net element of at least one partial region of the safety net, which protrudes over the interior region in a direction parallel to a main extension direction of the safety net, comprises at least a number of wire windings which deviates substantially from a mean number of wire windings of net elements outside the partial region.

14. The safety net as claimed in claim 1, wherein at least one net element of at least one partial region of the safety net, which protrudes over the interior region in a direction parallel to a main extension direction of the safety net, comprises at least one energy absorber.

15. The safety net as claimed in claim 14, wherein the energy absorber is realized integrally with the at least one net element.

16. The safety net as claimed in claim 1, wherein at least one net element realizes precisely three connection regions to neighboring net elements.

17. A net and rope construction having a safety net as claimed in claim 1.

18. The net and rope construction as claimed in claim 17, further comprising at least one guide rope which is guided through at least every third net element of a row of net elements, which extends parallel to a main extension direction of the safety net, on at least one outer edge of the safety net.

19. The net and rope construction as claimed in claim 18, wherein the guide rope is realized as at least one support rope.

20. A use of a safety net as a catch net in a net and rope construction, in particular as it is claimed in claim 17.

* * * * *